US008454388B2

(12) United States Patent
Song

(10) Patent No.: US 8,454,388 B2
(45) Date of Patent: Jun. 4, 2013

(54) MICRO-USB CONNECTOR

(75) Inventor: Xiao-Jun Song, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/048,273

(22) Filed: Mar. 15, 2011

(65) Prior Publication Data

US 2011/0312218 A1 Dec. 22, 2011

(30) Foreign Application Priority Data

Mar. 15, 2010 (CN) ..... 2010 2 0133499

(51) Int. Cl.
*H01R 13/648* (2006.01)

(52) U.S. Cl.
USPC ..... 439/607.36

(58) Field of Classification Search
USPC ..... 439/607.36, 607.35, 607.54, 607.4
See application file for complete search history.

(56) References Cited

U.S. PATENT DOCUMENTS 5,928,035 A * 7/1999 Jankowsky et al. ..... 439/607.36
6,280,251 B1 * 8/2001 Nishio et al. ..... 439/607.36
6,315,608 B1 * 11/2001 Lopata et al. ..... 439/607.36
7,004,792 B2 * 2/2006 Shimizu ..... 439/607.36
7,351,105 B2 * 4/2008 Delaney et al. ..... 439/607.36
7,748,999 B1 * 7/2010 Sun et al. ..... 439/79
7,837,506 B1 * 11/2010 Chiang et al. ..... 439/607.27

FOREIGN PATENT DOCUMENTS

CN 2802778 Y 2/2006
CN 2886841 Y 4/2007

* cited by examiner

*Primary Examiner* — Gary F. Paumen
(74) *Attorney, Agent, or Firm* — Stephen L. Sheldon

(57) ABSTRACT

A connector includes a plurality of terminals, a housing to fix these terminals, and a shield surrounding the housing. Each terminal comprises a mating portion, a soldering portion, and a connecting portion extending therebetween. The housing comprises a main body and a tongue portion extending forward from the main body and the shield comprises a top wall, a base, and two side walls positioned opposite each other, the walls forming a mating cavity with an opening at the front. The base is formed by the meeting of the two half bases, which are formed by the lower edges of the two side walls extending out toward each other, there is a first soldering leg on each half base, and the first soldering leg extend from a front edge of each half base first in a downward direction and then in a horizontal direction toward a rear of the connector.

9 Claims, 5 Drawing Sheets

FIG. 8
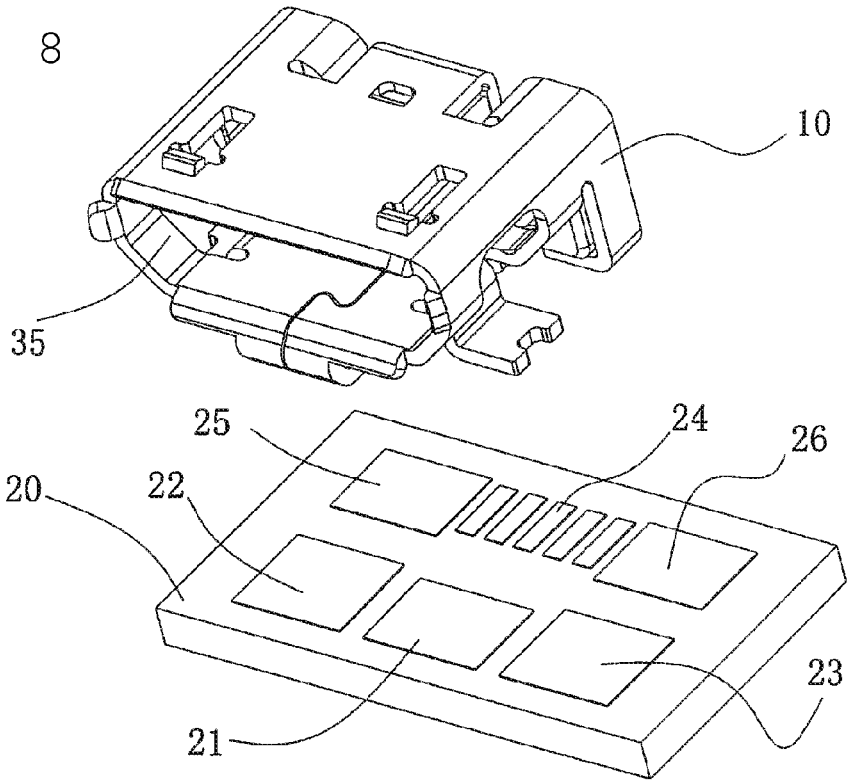
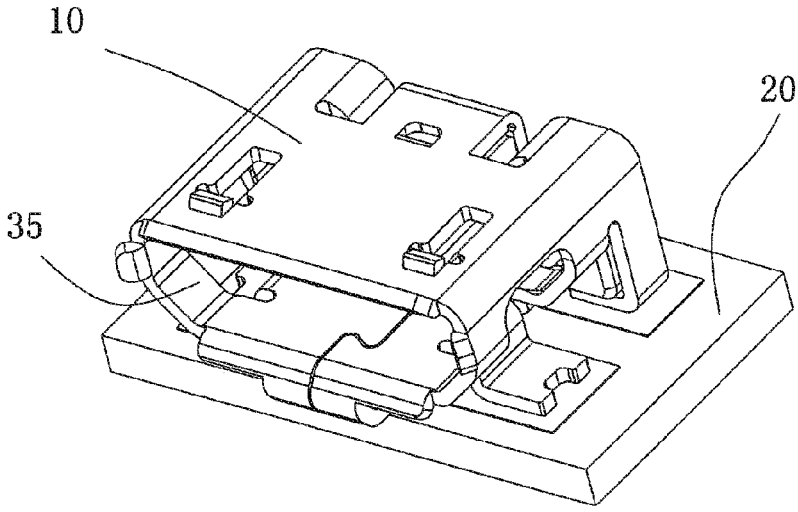
FIG. 9

MICRO-USB CONNECTOR

RELATED APPLICATIONS

This application claims priority to Chinese Application No. 201020133499.0, filed Mar. 15, 2011, which is incorporated herein by reference in its entirety.

TECHNICAL FIELD

The present invention relates to an connector, and more specifically, to an connector that provides additional structure support.

BACKGROUND ART

The structure of existing Micro-USB sockets typically comprise an insulator body (often referred to as a housing), a plurality of terminals arranged within the housing, and a shield surrounding the housing. In order to securely fix the Micro-USB socket to the circuit board, to guard against having the applied force of another mating plug influence the electrical connection between the Micro-USB socket and the circuit board when that plug connects with the Micro-USB socket, and finally to extend the life of the Micro-USB socket, the usual approach is to start by changing the structure of the shield. For example, in the connector shield structure described in Chinese patent CN280778Y, the shield comprises an upper flat plate and two side plates, the front ends of the two side plates have a joining portion that can snap together, and each of the rear edges of the two joining portions has a flange that is bent and extends downward; when the two joining portions are snapped together, these two flanges form a flange region, and the flange region can be soldered or fastened to the slot of the circuit board. For one thing, using this type of flange region structural arrangement can reinforce the connection between the Micro-USB socket and the circuit board. For another thing, it can provide support for the port space at the front end of the socket, thus enabling the socket to withstand the applied force of mating plugs being inserted and removed numerous times. However, the flange region of such a structure is on approximately the same straight line, horizontally, as the forward fixing legs extending downward from the two side plates, and all are distributed toward the front of the middle portion of the shield. As a result, when another mating plug is inserted and downward insertion force is exerted and acts on the front end of the connector's shield, the forward fixing leg of the shield and the flange region can act as a fulcrum, generating turning torque and lifting the rear portion of the connector, leading to the detachment of the soldering portion of the terminals and thus harming the electrical connection between the connector and the circuit board. Therefore, there is room for further improvement.

SUMMARY OF THE INVENTION

A connector is provided, comprising a plurality of terminals, a housing used to fix these terminals, and a shield surrounding the housing; each terminal comprises a mating portion, a soldering portion, and a connecting portion connecting the mating portion and soldering portion. The housing comprises a main body and a tongue portion extending forward from the main body. The shield comprises a top wall, a base, and two side walls positioned opposite each other, the described walls come together to form a mating cavity with an opening at the front, the base is formed by the meeting of the two half bases, which are formed by the lower edges of the two side walls extending out toward each other. In an embodiment there is a first soldering leg on each half base, and the first soldering leg is bent and extended from the front edge of each half base first downward and then horizontally toward the back.

BRIEF DESCRIPTION OF THE DRAWINGS

FIG. 8 is an exploded perspective drawing showing an embodiment of the connector of the present invention and a circuit board.

FIG. 9 is an assembly perspective drawing showing an embodiment of the connector of the present invention and a circuit board.

DETAILED DESCRIPTION OF THE PREFERRED EMBODIMENTS

Figure 1:
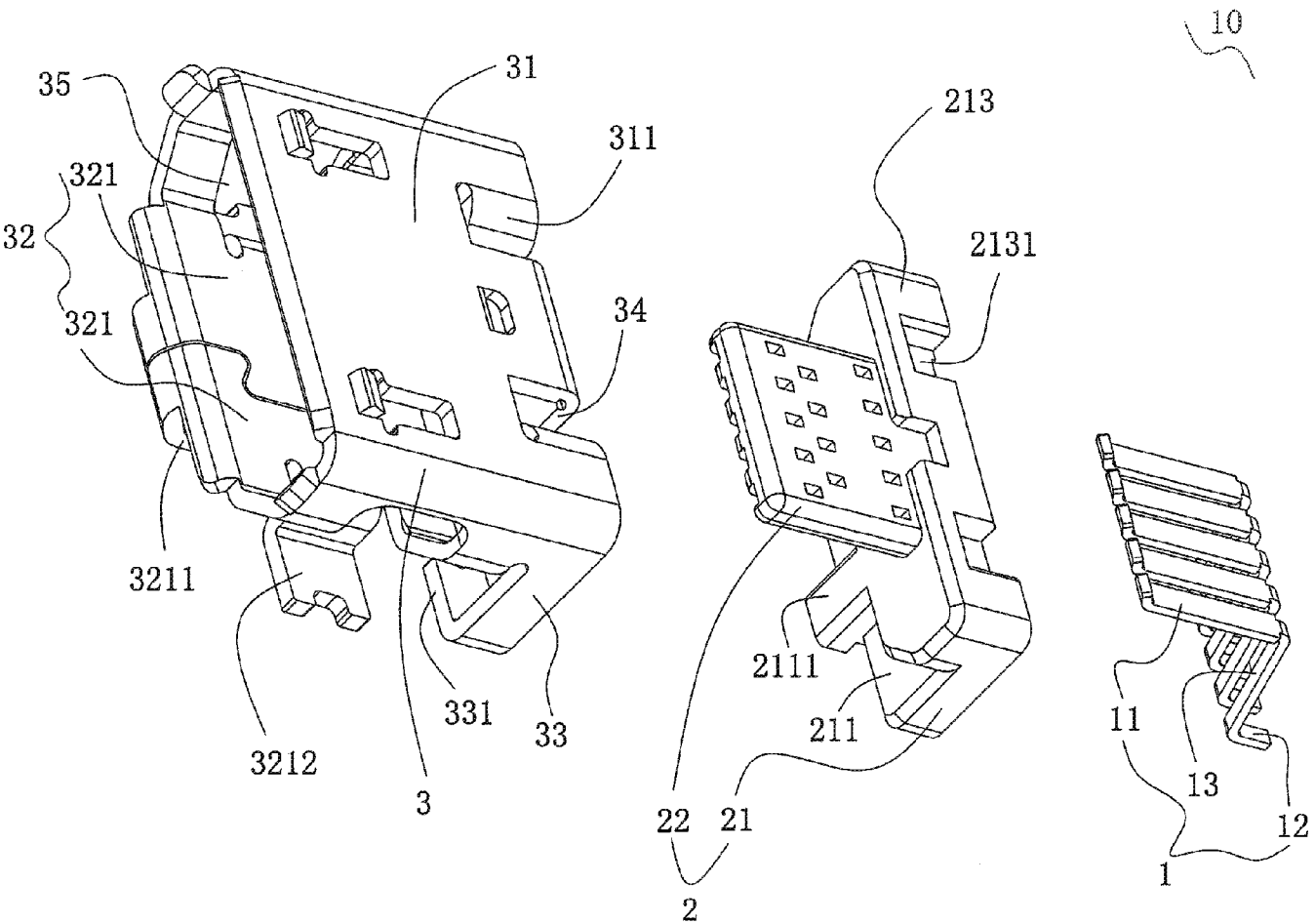
FIG. 1 is an exploded perspective drawing showing an embodiment of a connector, wherein the terminals, housing, and shield have been fully separated.
Figure 2:
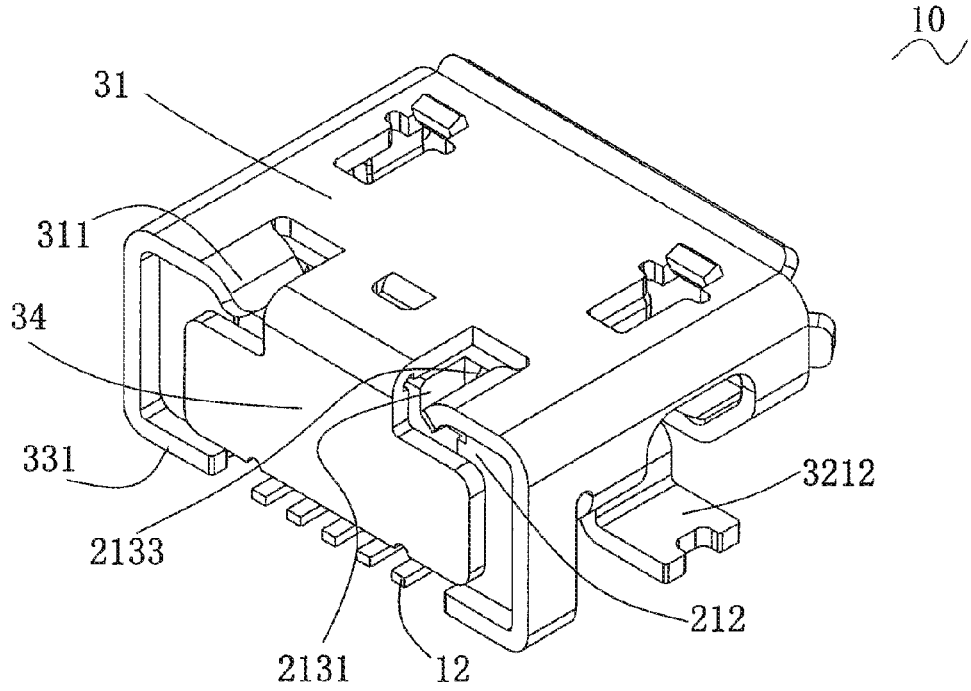
FIG. 2 is an assembly perspective drawing showing an embodiment of the connector.
Figure 3:
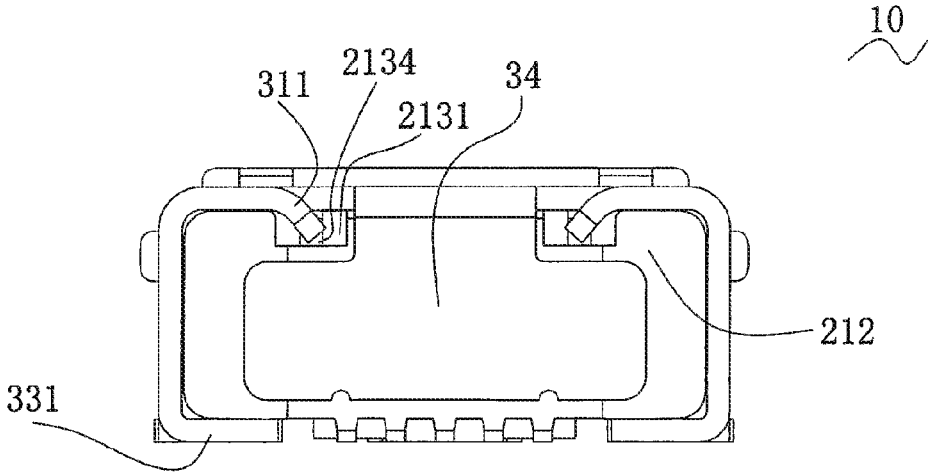
FIG. 3 is an assembly perspective drawing showing an embodiment of the connector of the present invention from another perspective.

The following, in combination with the attached Figures, gives a more detailed description of the invention using a Micro-USB socket as an example.

The present disclosure helps overcome some of the shortcomings of existing technologies described above. It has been determined that by changing the soldering leg structure of the shield, it is possible to prevent the rear portion of the connector from lifting up and causing the soldering portion of the terminals to detach, in the end extending the life of the connector. Compared to existing technologies, the first soldering leg of the depicted connector bends and extends downward then backward horizontally from the front edge of each half base. Consequently, when it receives downward pressure exerted by another connector plug on the front end of the shield, the first soldering leg can provide upward elastic supporting force for the front end of the shield. Thus, it can counteract the downward pressure exerted on the front end of the shield by another connector plug and effectively prevent the generation of turning torque, and thus it can prevent the rear portion of the connector from lifting up and causing the soldering portion of the terminals to detach to such an extent that it harms the electrical connection between the connector's terminals and the circuit board. In the end, it can extend the life of the connector.

Illustrated in FIGS. 1 through 7 is a preferred embodiment of an connector 10, comprising a plurality of terminals 1, a housing 2 used to fix these terminals 1, and a shield 3 surrounding the housing 2. The terminals 1 are bent and stamped from metallic material, and each terminal comprises a mating portion 11, a soldering portion 12, and a connecting portion 13. Of these, the mating portion 11 and the soldering portion 12 extend horizontally in opposite directions from the two ends of the connecting portion 13, and the connecting portion 13 is roughly vertically connected between the mating portion 11 and the soldering portion 12.

Figure 5:
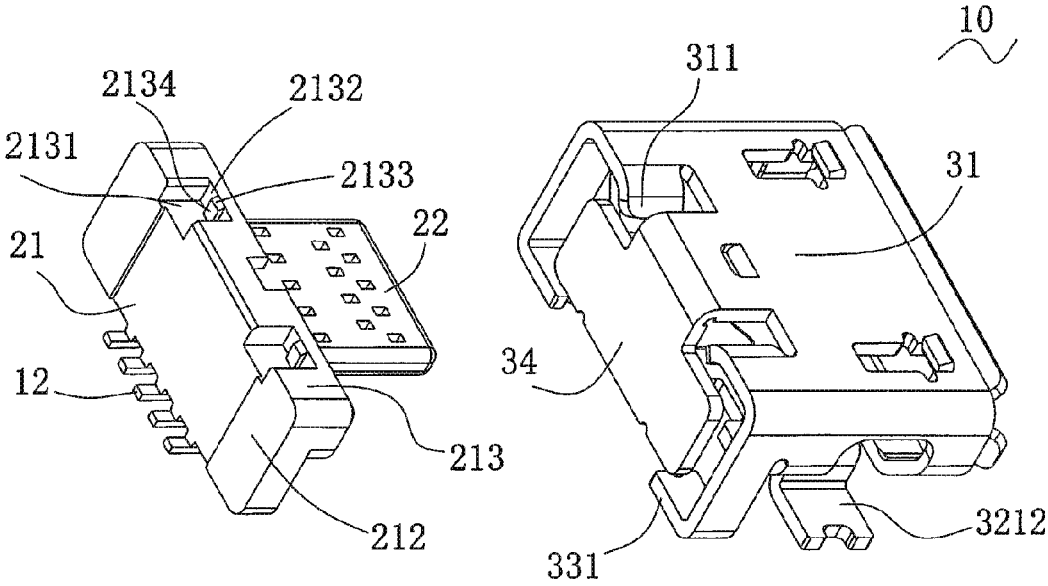
FIG. 5 is an exploded perspective drawing showing an embodiment of the connector of the present invention, wherein the terminals and housing are assembled.
Figure 6:
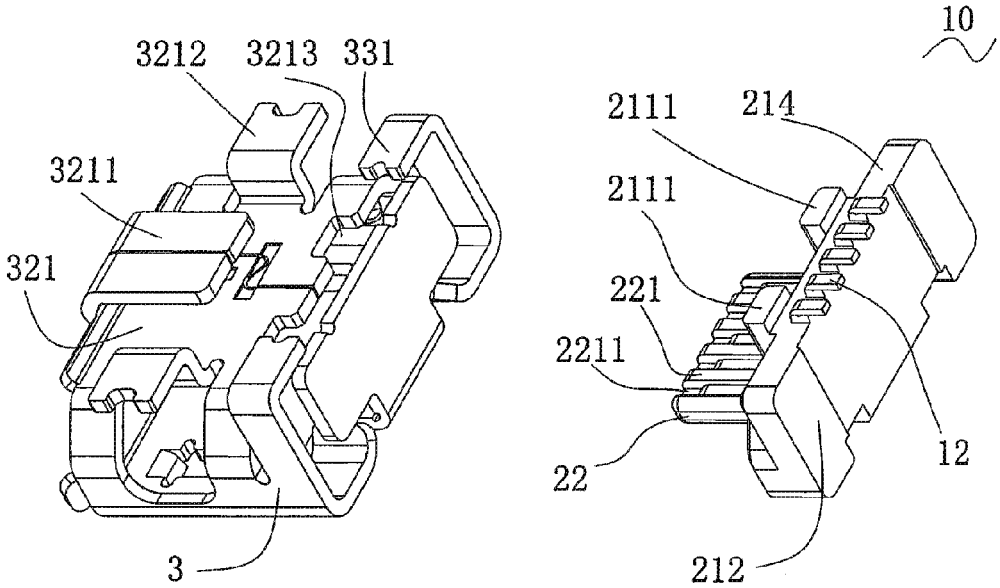
FIG. 6 is an exploded perspective drawing showing an embodiment of the connector of the present invention from another perspective, wherein the terminals and housing are assembled.
Figure 7:
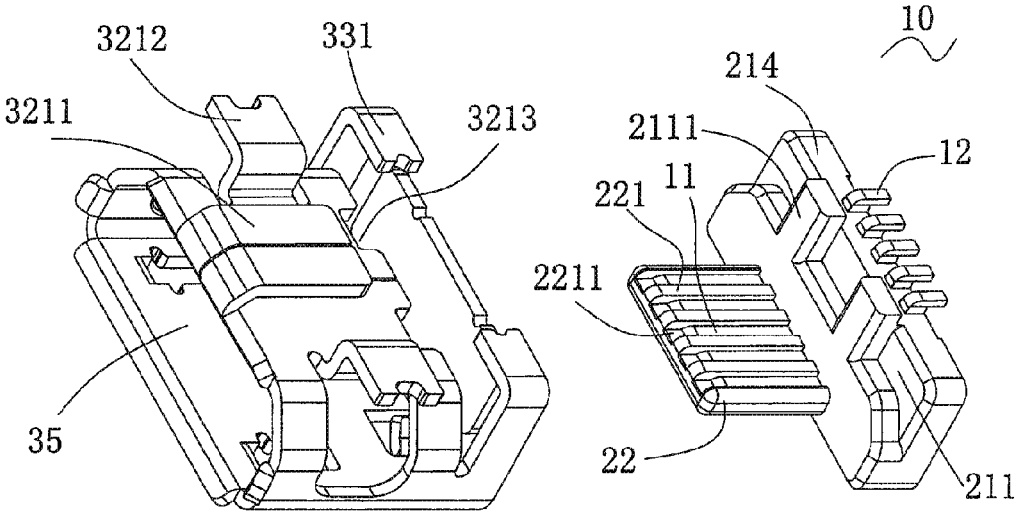
FIG. 7 is an exploded perspective drawing showing an embodiment of the connector of the present invention from yet another perspective, wherein the terminals and housing are assembled.

The housing 2 is molded around the terminals 1 using fused insulating plastic material, and it comprises a main body 21 and a tongue portion 22 extending forward from the main body 21. The depicted main body is roughly an oblong rectangular block, and it comprises a front face 211, a rear face 212, an upper face 213, and a lower face 214. On the front face 211 below the tongue portion 22, there are two protruding portions 2111 protruding forward. Referring to FIG. 5, there are two grooves 2131 connected to the rear face 212, located at the rear portion of the upper face 213. The grooves 2131 are rectangular grooves, and their front side walls 2132 have a projection 2134 extending vertically and protruding backward. The top of the projection 2134 has a lead-in ramp 2133. Referring to FIG. 6 and FIG. 7, the tongue portion 22 extends forward from the upper portion of the front face 211 of the main body 21, and the lower face 221 of the tongue portion 22 has five insertion grooves 2211 extending forward and backward. The connecting portion 13 of these terminals 1 is surrounded by the main body 21, the mating portion 11 is arranged one-to-one with the insertion groves 2211, and the soldering portion 12 extends backward from the lower face 214 of the main body 21.

The shield 3 is shown bent and stamped from metallic material, and it comprises a top wall 31, a base 32, two side walls 33 positioned opposite each other, and a rear wall 34 bending downward from the middle portion of the rear edge of the top wall 31. Referring to FIG. 7, the abovementioned walls together enclose a mating cavity 35 with an opening at the front.

The depicted two sides of the rear edge of the top wall 31 each have clinching plate 311 extending crosswise, and during assembly these two clinching plates 311 are pressed into the two grooves 2131 of the insulator 2 main body 21. Specifically, referring to features disclosed in FIG. 2 and FIG. 3, these two clinching plates 311 are pressed downward into the grooves 2131 and fit tightly with the projections 2134 in order to prevent the housing 2 from separating backward from the shield 3.

Figure 4:
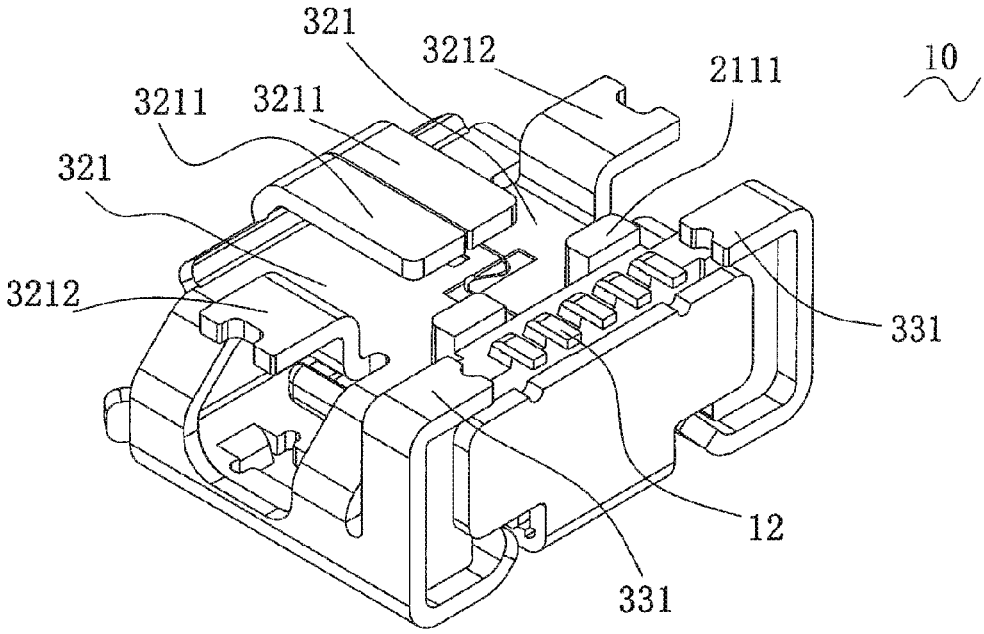
FIG. 4 is an assembly perspective drawing showing an embodiment of the connector of the present invention from yet another perspective.

Referring to FIG. 4, the base 32 is formed by the meeting of the two half bases 321, which are formed by the lower edges of the two side walls 33 extending horizontally toward each other. These two half bases 321 have a pair of first soldering legs 3211 and a pair of second soldering legs 3212. The first soldering leg 3211 is bent and extended from the front edge of the half base 321 first downward and then horizontally toward the back, and the second soldering leg 3212 is bent and extended from the lateral edge of the middle portion of the half base 321 first downward and then outward horizontally. Because the two first soldering legs 3211 are extend from two half bases 321 along a place where the two half bases meet (e.g., a common edge), these two first soldering legs 3211 can be viewed as one rather large soldering leg. Referring to FIG. 6 and FIG. 7, the rear edge of every half base 321 has a notch 3213, and the two protruding portions 2111 of the main body 21 can be fastened into the two notches 3213, thus achieving the goal of preventing the two half bases 321 from separating.

The two side walls 33 are joined to the top wall 31 and the base 32, and the lower edge of the back of each side wall 33 first bends and extends downward then inward horizontally into a third soldering leg 331. The two third soldering legs 331 are approximately level with the front and back of the soldering portion 12 of the terminals 1, and the bases of the two are also level. In addition, the third soldering leg 331 is level with the base of the first soldering leg 3211.

The following steps are an approximation of the assembly process that can be used for an embodiment of the connector 10. Stamp the terminals 1; use the insert molding technique to form an housing 2 around five terminals 1 lined up side by side; before the rear wall 34 of the shield 3 and the clinching plate 311 are stamped and bent downward, insert the housing 2 from back to front into the shield 3 until the two protruding portions 2111 are fastened into the two corresponding notches 3213; then stamp and bend the rear wall 34 of the shield 3 and the clinching plate 311 downward into shape, and via the lead-in ramp 2133, press the clinching plate 311 tightly against the top at the rear of the projection 2134, and press the rear wall 34 on the rear face 212 of the insulator's 2 main body 21, thus tightly fixing the housing 2 to the shield 3.

As shown in FIGS. 8 and 9, the circuit board 20 with an connector 10 has two rows of soldering pads. The first row has three large soldering pads 21, 22, and 23, and the second row has five small soldering pads 24 as well as two large soldering pads 25 and 26 located on the two sides of these small soldering pads. Of these, the large soldering pad 21 corresponds to the two first soldering legs 3211 of the connector 10, the large soldering pads 22 and 23 correspond to the second soldering legs 3212, the small soldering pads 24 correspond to the soldering portion 12 of the terminals 1, and the large soldering pads 25 and 26 correspond to the third soldering legs 331. In a one-to-one correspondence, each soldering leg and the terminals 1 of the connector are surface mount soldered to the soldering pads of the circuit board 20.

Compared to existing technologies, the depicted connector 10 can use a surface mounting mode for soldering to the circuit board 20 using the two first soldering legs 3211 on the base 32 of the shield 3, which bend and extend downward then backward horizontally from the front edge of the half base 321, raising the peel strength between the connector 10 and the circuit board 20, and it can guard against separation of the two half bases 321. In addition, when the front end of the shield 3 receives downward pressure exerted by another connector plug (not shown in the figures), because the support point of the connection between the first soldering leg 3211 and the shield 3 is at the very front of the shield 3, the first soldering leg 3211 can provide upward elastic supporting force for the very front of the half base 321 of the shield 3. Thus it can counteract the downward pressure exerted on the front end of the shield by another connector plug, effectively preventing the generation of turning torque and guarding against having the rear portion of the connector 10 lift up causing the soldering portion 12 of the terminals 1 to detach to such an extent that it harms the electrical connection between the connector's terminals 1 and the circuit board 20, and in the end it can extend the life of the connector 10.

The preceding details are merely a preferred embodiment and are not intended to limit the implementation schemes of the disclosure. A general technician or a person skilled in the art may make the relevant accommodations or revisions as is convenient based on the main concepts and spirit of the present invention. Therefore, the scope of protection for the present invention shall be determined by the scope of protection set forth in the claims.

What is claimed is:

1. A connector, comprising:

a plurality of terminals, each terminal including a mating portion, a soldering portion, and a connecting portion connecting the mating portion and soldering portion;

a housing used to fix the terminals, the housing including a main body and a tongue portion extending forward from the main body; and a shield surrounding the housing, the shield including a top wall, a base, and two side walls positioned opposite each other, the described walls come together to form a mating cavity with an opening at the front, the base is formed by the meeting of the two half bases, which are formed by the lower edges of the two side walls extending out toward each other, and a first soldering leg supported by each half base, wherein the first soldering leg is extends from a front edge of the respective half base in a downward direction and then horizontally toward a rear end of the connector, wherein a middle portion of the shield bends and extends downward to form two second soldering legs, and the rear portion of the shield bends and extends downward to form two third soldering legs.

2. The connector according to claim 1, wherein the two first soldering legs extend from the respective half bases and share a common edge therebetween.

3. The connector according to claim 1, wherein each of the second soldering legs extends from a corresponding lateral edge of the middle portion of the respective half base, the second soldering legs extending downward then outwardly in a horizontal direction.

4. The connector according to claim 3, wherein the third soldering legs each extend downward then inward in a horizontal direction.

5. The connector according to claim 4, wherein the rear edge of each half base of the shield has a notch, the front face of the insulator's main body has two protruding portions protruding forward, and these two protruding portions fit into the two notches to prevent the two half bases from separating.

6. The connector according to claim 4, wherein the rear edge of the top wall of the shield bends and extends crosswise downward in two clinching plates, the top of the insulator's main body has two grooves, and these two clinching plates fit these two grooves to prevent the housing from separating backward.

7. The connector according to claim 6, wherein inside each of the two grooves on the main body of the insulator there is a projection sticking out toward the back, the top of the projection has a lead-in ramp, and the two clinching plates of the shield, after bending downward, press tightly against the back of these two projections to prevent the housing from separating backward.

8. The connector according to claim 6, wherein the middle portion of the rear edge of the shield's top wall bends downward into a rear wall, the rear wall presses against the rear face of the insulator's main body, and the two clinching plates are situated on the two sides of the rear wall.

9. The connector according to claim 4, wherein the soldering portions of the terminals and the first soldering leg are soldered to a circuit board using the surface mounting method, and the bases of these soldering portions are level with the base of the first soldering leg.

* * * * *